United States Patent [19]

Melitz et al.

[11] 4,286,896

[45] Sep. 1, 1981

[54] DIVING STRUCTURE AND METHOD OF DEPLOYMENT OF THE STRUCTURE

[75] Inventors: Daniel T. Melitz, London; Kenneth L. Searle, Havant; Brian E. Woodman, Wickham Bishops, all of England

[73] Assignee: The British Petroleum Company Limited, London, England

[21] Appl. No.: 96,400

[22] Filed: Nov. 21, 1979

[30] Foreign Application Priority Data

Sep. 15, 1979 [GB] United Kingdom ..... 32050/79

[51] Int. Cl.[3] ..... B63C 7/02; B63C 11/00; B63C 11/44

[52] U.S. Cl. ..... 405/185; 114/258

[58] Field of Search ..... 405/185, 188, 190, 191; 114/244, 258, 259, 140; 414/137, 138, 139, 140

[56] References Cited

U.S. PATENT DOCUMENTS

| | | | |
|---|---|---|---|
| 904,241 | 11/1908 | Watson | 405/185 |
| 3,641,776 | 2/1972 | Diamond | 405/185 |
| 3,754,404 | 8/1973 | Moore | 405/188 X |
| 3,807,334 | 4/1974 | Egeberg | 405/185 X |
| 3,851,492 | 12/1974 | Cannon et al. | 405/191 |
| 4,087,980 | 5/1978 | Kono | 405/188 |
| 4,111,313 | 9/1978 | Reiher et al. | 405/185 X |
| 4,170,429 | 10/1979 | Mathieu | 405/185 X |

FOREIGN PATENT DOCUMENTS

| | | | |
|---|---|---|---|
| 7710702 | 4/1978 | Netherlands | 114/258 |

*Primary Examiner*—Stephen J. Novosad

*Attorney, Agent, or Firm*—Morgan, Finnegan, Pine, Foley & Lee

[57] ABSTRACT

A diving bell deployment structure includes a launch tube for a diving bell, the bell having a supporting bell hoist wire. A boom is positioned from the structure to a point vertically above the desired underwater deployment position, and carries a boom hoist wire which is capable of connecting to the bell through the base of the launch tube. Differential pay out of the boom hoist wire and bell hoist wire allows exit of the bell from the launch tube and lateral deployment of the boom and launch tube.

10 Claims, 4 Drawing Figures

DIVING STRUCTURE AND METHOD OF DEPLOYMENT OF THE STRUCTURE

Figure 1:
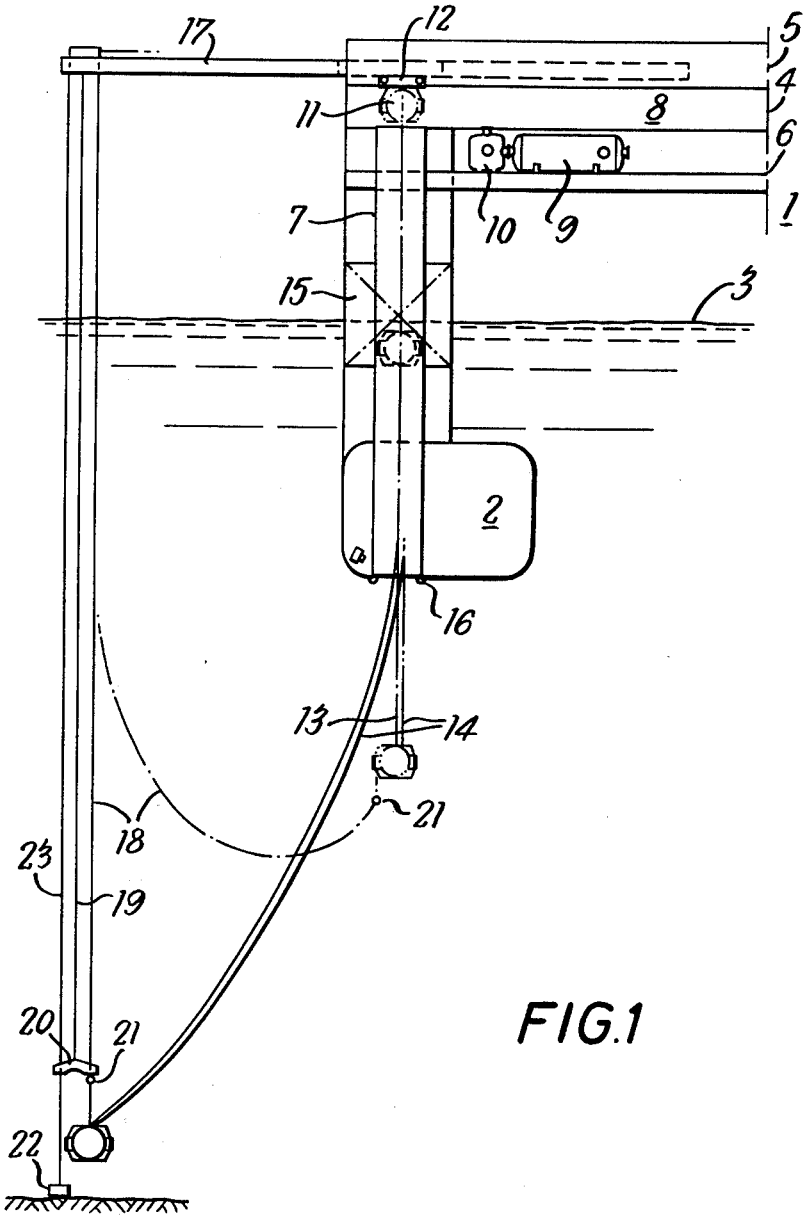

The present invention relates to diving structures and more particularly relates to the deployment of a diving bell through the launch tube of a diving structure.

The use of diving bells for sub-sea operations, e.g. maintenance of pipelines, production platforms and rigs, has become of increasing importance. However, the time available for the operation is often limited because of unfavourable sea conditions. The heaving of the sea poses problems of entry of the bell into the water and can cause physical discomfort to the diving personnel thus impairing work capacity and basic safety conditions and causes serious risk of bell wire breakage. A launch tube suitable for launching underwater craft is disclosed in our GB patent application No. 17314/77. These problems are further emphasised when it is desired to transfer the bell to an outreach position which lies beyond the profile of the diving structure.

The present invention is directed towards an improved diving bell deployment system which allows the diving bell to be positioned close to the structure to be serviced, e.g. a fixed offshore platform while the diving structure such as a special purpose semi-submersible vessel from which the diving bell is launched can be maintained at a convenient distance from it by use of dynamic positioning.

Although suited to installation in a semi-submersible structure, the system disclosed may be used with other types of floating vessels or fixed structures.

Thus according to the present invention there is provided a diving bell deployment structure comprising a launch tube capable of launching a diving bell, the bell having a bell hoist wire characterised in that a boom is adapted to be positioned from the structure to a point vertically above the desired underwater deployment position, the boom carrying a boom hoist wire which is capable of connecting to the bell through the base of the launch tube so that differential pay out of the boom hoist wire and bell hoist wire allows exit of the bell from the launch tube and lateral deployment of the bell between the boom and launch tube.

Preferably the boom also has a wire or line attached to a sinker weight which passes beneath the waterline to the desired deployment position. Preferably, after or during the lowering of the bell to the required working depth, a sliding collar is lowered from the boom to hold the boom hoist wire and boom sinker weight guide wires to resist bell movement due to currents and tides and to hold the bell on location.

Preferably the boom hoist wire has a bob weight to keep the slack catenary of the boom hoist wire below the bell during passage of the bell through the launch tube. The bob weight may also act as a stop or limit for the sliding collar.

The wires attached to the diving bell preferably incorporate passive heave compensation of the conventional type to counteract the relative motion of the deployment structure and the bell due to wave or tide motions.

The launch tube used is preferably of the type described in our GB patent application No. 17314/77 and comprises a substantially vertical passageway having a surrounding surge chamber adjacent to the liquid surface, the surge chamber communicating with the passageway through a perforated section of the passageway, the chamber and perforations being of a size and distribution in relation to the passageway such that there is damping of liquid oscillation in the tube.

Diving bells are preferably of the conventional type having a thick walled steel sphere enclosing the diving personnel and equipment. Preferably the sphere is supported by a tripod or leg arrangement and in operation is passed into the launching tube by a cable and winch arrangement. The bell is preferably fitted into a tubular guide frame suspended on a main hoist cable and served with umbilical cable supplies, e.g. air, heat. Most preferably a heavy guide frame is used to add weight and to steady and centralise the bell during exit and re-entry to the launch tube. The guide frame is arrested and detached from the bell at the base of the launch tube during entry.

For use with a semi-submersible rig, the passageway of the launching tube may pass from the upper deck of the rig through the surge chamber or pontoon of the rig and thence opens into the sea proper at the keel.

Around the exit of the launch tube, a toroidal pipe supplying pressure gas may be used to aerate the water inside the tube. A perforated high pressure air tube is preferably used. It is believed that the aeration acts by reducing the effective density of the water in the tube thereby reducing the hydrodynamic forces on the bell.

The boom is preferably adjustable in length, most preferably retractable and is adapted to be extended beyond the main profile of the diving structure. The boom is adapted to carry the boom hoist wire and preferably the sinker weight guide wires and boom sliding collar.

According to a further aspect of the invention there is provided a method of deploying a diving bell from a structure comprising the steps of (a) lowering the bell below the waterline through a launch tube in the structure by means of an attached bell hoist wire while maintaining slack a boom hoist wire connected between the bell through the exit of the launch tube and thence to a boom projecting beyond the profile of the structure, (b) stopping the payout of boom hoist wire while allowing payout of bell hoist wire until the weight of the bell is supported by the boom hoist wire and then (c) paying out or reeling in the bell hoist wire and boom hoist wire to adjust the vertical height of the bell to the desired deployment position.

The invention will now be described by way of example only with reference to FIGS. 1 to 3 of the accompanying drawings.

Figure 2:
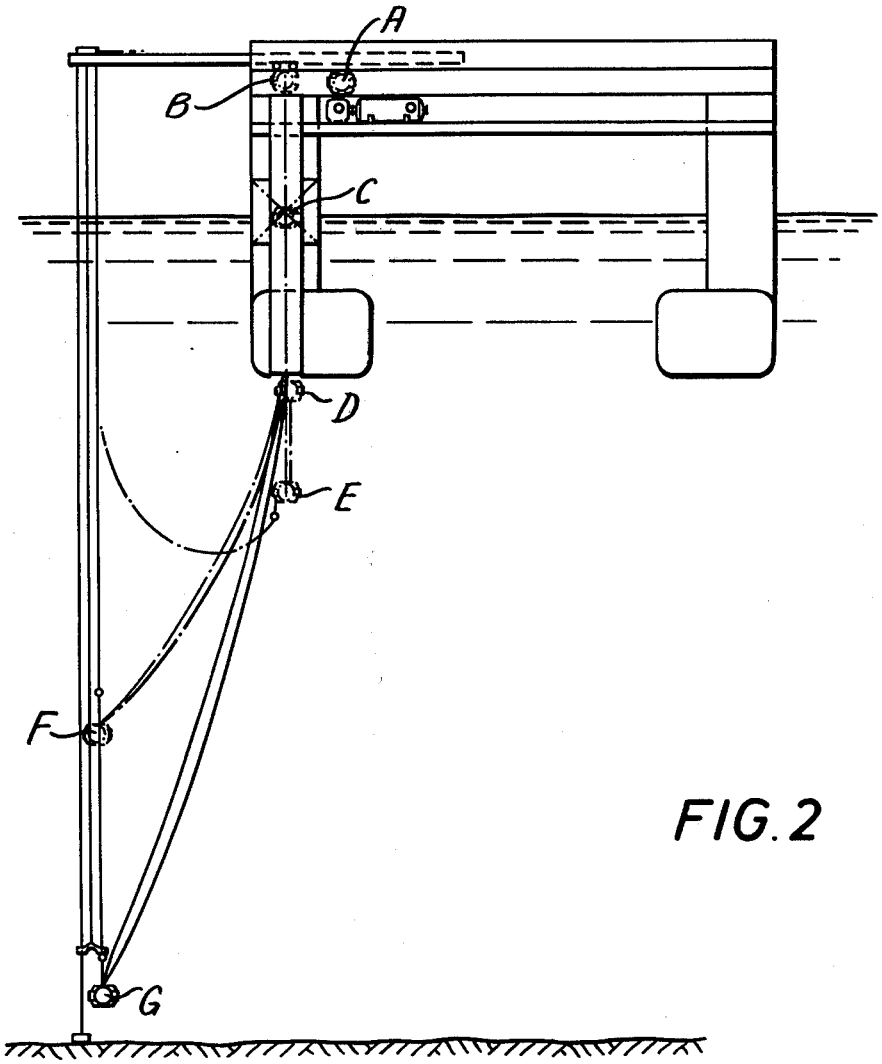

FIG. 1 shows a schematic diagram of a semi-submersible vessel fitted with a diving bell deployment system according to the invention and FIG. 2 shows the various stages of deployment of the diving bell. FIGS. 3(*a*) and 3(*b*)show schematic diagrams for the sliding collars used to locate the position of the diving bell. In particular, FIG. 3 (*a*) shows an embodiment wherein a single guideline is used and FIG. 3 (*b*) another in which a double guideline is utilized.

A semi-submersible vessel 1 has a pontoon 2 lying beneath the waterline 3 and main, upper and lower decks 4,5,6 above the water line 3. A smooth bore vertical launch tube 7 passes between the decks and allows access to the sea below via the pontoon 2.

At the upper end of the launch tube 7, an deck diving complex 8 is provided with ancillaries such as decompression and transfer chambers 9,10 with provisions for "casevac" of an injured diver and for total hyperbaric avacuation.

The diving bell 11 is a spherical steel chamber and is adapted to be fitted into a tubular guide frame 12. The bell 11 is attached to a bell hoist cable 13 and is served with life support supplies etc. by means of umbilical cables 14. To add weight to the bell 11 and hence steady its progress through the air-sea interface, the heavy guide frame 12 is carried by the bell 1 from its position of release in the transfer lock 10 to its exit from the lower tube position. This guide frame also centralises the bell, its attendant hoist wire and the umbilicals, during exit and re-entry of the bell at the lower tube position.

A surge chamber 15 installed at the launch tube waterline level is used to reduce the amplitude and velocity of water movement in the launch tube 7 which otherwise may damage the bell or injure the divers within. The surge chamber used was of the type described in our GB patent application No. 17314/77. A toroidal pipe 16 at the base of the launch tube 7 provides aeration of the water in the tube thereby reducing the mass effect of the moving water column.

A retractable boom 17 is incorporated into the upper deck 5 of the vessel 1. This is a beam structure which can be extended beyond the main profile of the vessel from a normally retracted and stowed position. The boom 17 carries wires and sleeves etc. to form a boom hoist wire 18 for the bell 11, sinker weight guide wire 23, sliding collar hoist wire 19, and a boom sliding collar 20.

The boom hoist 18 is the main hoist wire used to raise and lower the bell when it is deployed. The wire incorporates passive heave compensation. A small bob weight 21 is incorporated in wire 18 close to the bell 1.

To retain the boom hoist wire 18 close to the sinker weight wires 23 and hence retain the bell on station in tidal conditions, the boom collar 20 embraces the boom hoist wire 18, the sinker weight guidewire 23 when lowered to the small bob weight 21 just above the bell 11. This device may have twin or triple wire sliding sleeves depending on whether single or double guide wires are used. (FIGS. 3 (*a*) and 3(*b*).

A sinker weight 22 is stowed adjacent to the upper tube position and can be deployed through the tube 7 in advance of the bell if it is required. A second sinker weight is stowed adjacent to the boom position and can be deployed from the boom in advance of deploying and traversing the bell, if it is required. (FIGS. 3(*a*) and 3(*b*). The option is provided to use sinker weights and guide wires to aid stability of the bell at the worksite. These guide wires incorporate heave compensation. The total bell deployment systems can however be used without the sinker weight and guide wire systems if other conditions allow this, e.g. zero current.

Figure 3A:
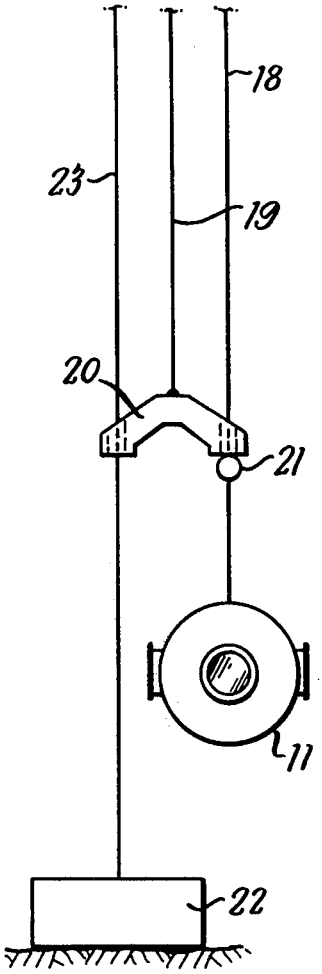
Figure 3B:
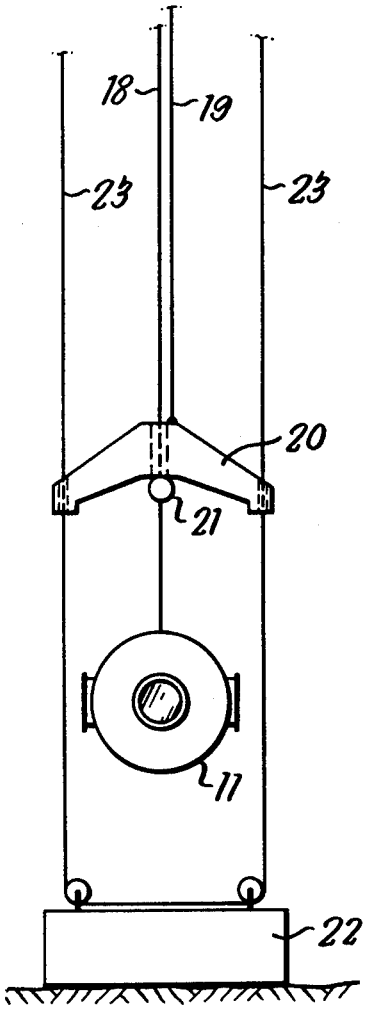

As indicated above, FIGS. 3(*a*) and 3(*b*) show schematic diagrams for the sliding collars used to locate the position of the diving bell. FIG. 3(*a*) shows an arrangement wherein a single guide wire is used, whereas FIG. 3(*b*) shows an arrangement for twin guide wires. In said Figures, there is shown the diving bell 11 supported by the boom hoist wire 18. The sinker weight 22 is attached to sinker weight wire 23 and the boom sliding sleeve 20 is supported by guide wire 19. As in FIG. 1, the numeral 21 indicates the small bob weight. It is noted that the sliding sleeve 20 is a twin wire sleeve in FIG. 3(*a*) and a double wire sleeve in FIG. 3(*b*).

In use, the diving bell deployment system is operated as follows. The boom hoist wire 18 is attached to the lift point of the bell 11 by a pre-fixed messenger wire (not shown). The boom hoist wire 18 is slack at the stage. The bell unclamped from the transfer chamber 10 and the bell 11 raised until it supports the weight of the guide frame 12. (Position A). The bell 11 and guide frame 12 are then traversed to a point above the launch tube 7 (Position B).

The bell and guide frame 11, 12 are lowered down through the surge chamber 15 (position C) to the bottom of the tube 7 where the aeration tube 16 retains the guide frame 12 which in turn centralizes the hoist wire 13 and umbilicals 14 (position D). The bell 11 is then lowered to a depth at which it is convenient to engage heave compensation (position E). Throughout the foregoing procedure, the boom hoist wire 18 is sufficiently slack to allow the bell to travel.

The payout of the boom hoist wire 18 is then stopped while continuing the payout of the tube hoist wire 13 until the bell weight is totally transferred to the boom hoist wire 18. The bell 11 is then plumb below the end of the extended boom 17 (position F). The boom hoist wire 18 and tube hoist wire 13 are then paid out together maintaining tension and heave compensation on the hoist wire and allowing adequate slack only in the tube hoist wire to permit the desired bell travel, until the working depth is reached (position G).

When conditions warrant the use of a sinker weight 22 and guide wires 19, they would be deployed prior to the bell in the following manner. The boom 17 is extended about 4 meters and the sinker weight 22 lowered to the sea bed. Heave compensation for the sinker weight guide wire 23 is engaged. After lowering the bell 11 to the required working depth, a sliding collar 20 is lowered from the boom 17. The collar 20 embraces the boom hoist wire 18 and sinker weight guide wire 23 to ensure that the bell is held on location in tidal conditions (position H).

The boom hoist wire 18 incorporates a bob weight 21 about 3 meters from the bell attachment shackle. This ensures that the slack catenary of the boom hoist wire remains below the bell while travelling in the tube and also acts as a stopper or limit to the lowered position of the collar 20.

A closed circuit television camera system may be use to monitor the exit and entry of the diving bell into the launch tube.

We claim:

1. A diving bell deployment structure comprising a launch tube capable of launching a diving bell, the bell having a bell hoist wire and means for lowering and raising the bell via said bell hoist wire characterised in that a boom is adapted to be positioned from the structure to a point vertically above the desired underwater deployment position, the boom carrying a boom hoist wire which is capable of connecting to the bell through the base of the launch tube so that differential pay out of the boom hoist wire and bell hoist wire allows exit of the bell from the launch tube and lateral deployment of the bell between the boom and launch tube.

2. A structure according to claim 1 in which the boom has a wire or line attached to a sinker weight.

3. A structure according to claim 2 comprising a sliding collar adapted to engage the boom hoist wire and boom sinker weight wire.

4. A structure according to claim 1 in which the boom hoist wire carries a bob weight.

5. A structure according to claim 1 which the diving bell wires incorporate passive heave compensation.

6. A structure according to claim 1 in which the launch tube comprises a substantially vertical passageway having a surrounding surge chamber adjacent to the liquid surface, the surge chamber communicating with the passageway through a perforated section of the passageway, the chamber and perforations being of a size and distribution in relation to the passageway such that there is damping of liquid oscillation in the tube.

7. A structure according to claim 1 in which the diving bell is fitted into a detachable guide frame while in the launch tube during exit and re-entry.

8. A structure according to claim 1 having means for aerating the water inside the launch tube.

9. A structure according to claim 1 in which the boom is continuously adjustable in extended length beyond the outer profile of the structure.

10. A method of deploying a diving bell from a structure comprising the steps of:

(a) lowering the bell below the waterline through a launch tube in the structure by means of an attached bell hoist wire whilst maintaining slack a boom hoist wire connected between the bell through the exit of the launch tube and thence to a boom projecting beyond the profile of the structure, (b) stopping the payout of boom hoist wire while allowing payout of bell hoist wire until the weight of the bell is supported by the boom hoist wire and then (c) paying out or reeling in the bell hoist wire and boom hoist wire to adjust the vertical height of the bell to the desired deployment position.

* * * * *